United States Patent [19]

Long et al.

[11] 4,420,913

[45] Dec. 20, 1983

[54] ROOF RIDGE STRUCTURE AND SYSTEM

[75] Inventors: Gene M. Long, Houston, Tex.; Terry E. DeWitt, Memphis; John R. Bell, III, Germantown, both of Tenn.

[73] Assignee: AMCA International

[21] Appl. No.: 284,970

[22] Filed: Jul. 20, 1981

[51] Int. Cl.[3] ..... E04B 7/00

[52] U.S. Cl. ..... 52/57; 52/54; 52/90

[58] Field of Search ..... 52/93, 94, 556, 58, 52/60, 57, 45, 47, 48, 53, 54, 630, 90

[56] References Cited

U.S. PATENT DOCUMENTS 1,149,572 8/1915 Gall ..... 52/55

2,664,177 12/1953 Hammitt ..... 52/58

FOREIGN PATENT DOCUMENTS 2259920 6/1974 Fed. Rep. of Germany ..... 52/52

*Primary Examiner*—John E. Murtagh

*Assistant Examiner*—Kathryn L. Ford

*Attorney, Agent, or Firm*—Harness, Dickey & Pierce

[57] ABSTRACT

An apparatus and method for covering the ridge or peak of a metal roof system is disclosed. After the metal roofing panels are set in place on the sloping surfaces of the roof and seamed together, mating halves of a ridge panel are positioned along the ridge and parallel thereto. The mating halves have cut-outs corresponding to the rib seams of the roofing panels, the cut-outs each being covered by a seam cap. After the ridge panel halves are secured to the roofing panels, the interlocking joint between them is folded over and permanently seamed together. Finally, the areas at the ends of the ridge adjacent the rakes of the building are covered by filler panels. The filler panels have cut-outs corresponding to the rib seam of the ridge panel, and the cut-outs are similarly covered by seam caps.

11 Claims, 21 Drawing Figures

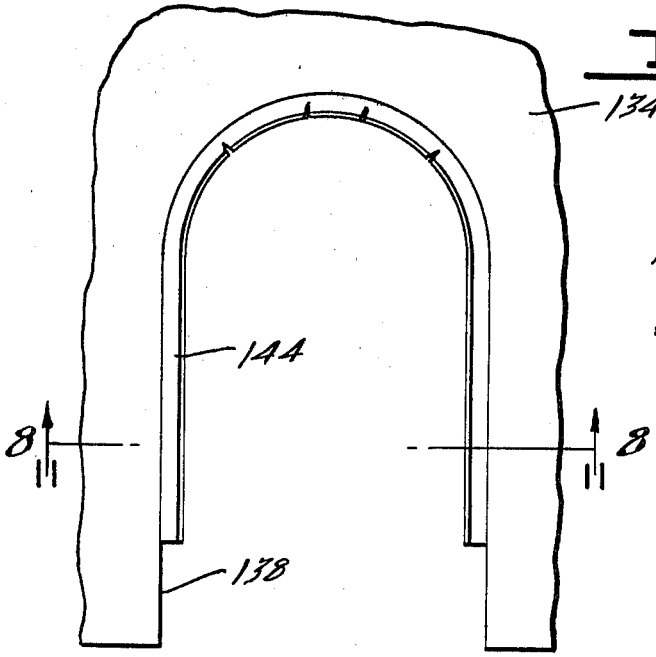
FIG. 7.
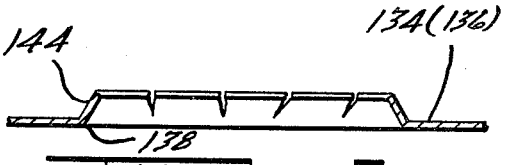
FIG. 8.
FIG. 9.
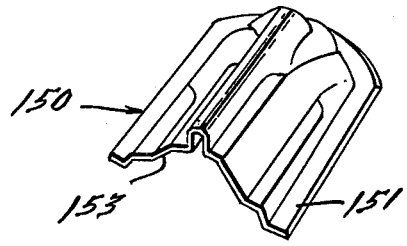
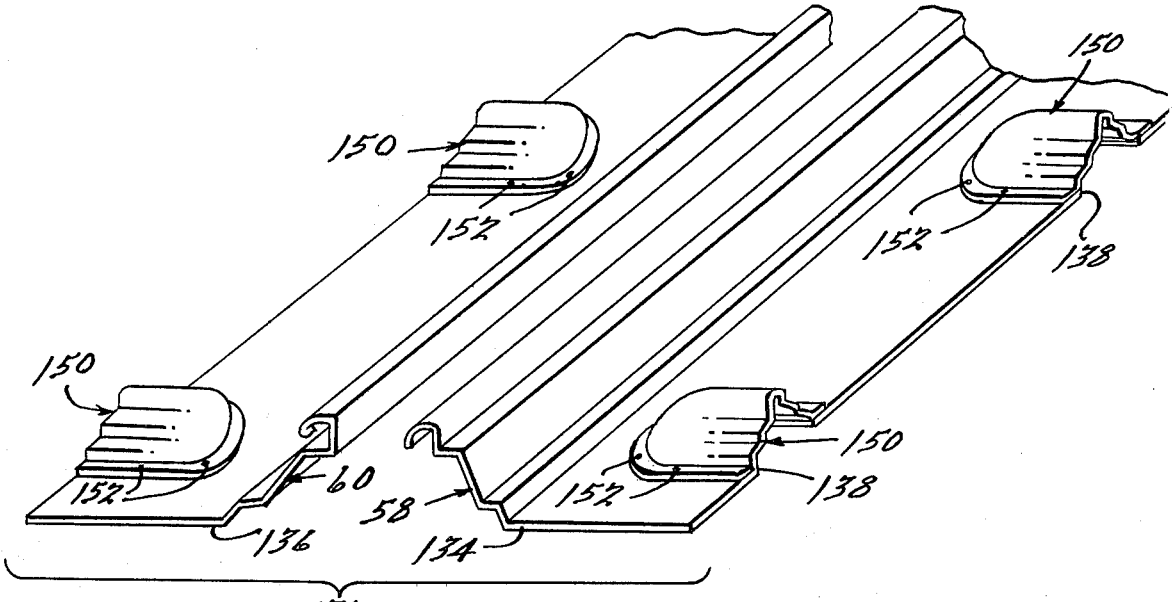
FIG. 10.

ROOF RIDGE STRUCTURE AND SYSTEM

BACKGROUND—SUMMARY OF THE INVENTION

The present invention relates to improved ridge systems for metal roofing structures. Metal roofing systems are popular today for a variety of purposes and are particularly used to cover large free standing metal buildings which have many uses and applications.

The improved ridge systems of the present invention are particularly designed for use with seamed metal roofing systems, that is roofing systems made up of individual metal panels which are interlocked together along their edges with the interlocking edge joints being roll seamed permanently together. Metal roofing structures of this type are described, for example, in U.S. Pat. Nos. 4,193,247, 4,213,282 and 4,224,775, all of which are assigned to the same assignee as the present invention. The present ridge system was designed as an improvement over the ridge systems used with the standing seam roof systems disclosed in those patents.

In general, two types of ridge systems are currently in use on standing seam roof systems. The first is formed of a molded one-piece synthetic (plastic) material which is die formed to the configuration of the roof to which it is applied. This ridge system has a number of disadvantages, such as the inability to match the configuration of the radii of the roof panels (thus relying on a substantial amount of sealant to fill the gaps), the inability to compensate for misalignment of roof panel major ribs, insufficient length (thus requiring more pieces and more end laps), the need for metal reinforcing to adapt it to the ridge accessories, possible damage by foot traffic, and need for additional metal parts in some cases.

The second type of present ridge system is made of all metal components or a combination of metal and synthetic components. This system also has disadvantages. It requires a large number of parts that vary in size, shape and material; it uses a substantial quantity of mastic and sealant; it requires numerous different fasteners and rivets; and it is difficult and complex to assemble, resulting in high field labor costs and difficulties with weather tightness.

It is a purpose of the present invention to overcome the above-identified disadvantages of presently-used ridge structures and systems. The present invention has been designed to utilize fewer parts and components, to be simpler and more economical to assemble, to be adaptable to various conditions (such as roofs of different slopes or which have misaligned major ribs), and to assure high quality workmanship and weathertightness.

These and other objects and purposes of the invention are accomplished by use of the present invention which is described in summary immediately below and described in more detail hereinafter when viewed in accordance with the accompanying drawings.

In accordance with the invention, two mating and interlocking halves of a ridge panel with a plurality of seam caps are used to securely and permanently cover the opening at the ridge or peak of the metal roof structure of the building. The two halves of the ridge panel interlock and are seamed together in the same manner as the main roof panels. After the lock panels are interlocked, attached to the main building structure (purlins) and seamed together, one of the halves (the male half) is positioned on and fastened to the upper edge of one of the angled roof surfaces. Prior to this step, openings are cut out in the two ridge panel halves corresponding to each of the main standing seam panel ribs and seam caps are fastened over each of the openings. The seam caps have raised configurations matching the shape of the standing seam ribs. Once the male ridge panel section is fastened in place, the female ridge panel (with cut-outs covered by seam caps) is installed in place on the edge of the other roof surface. The raised mating edge structures of the male and female ridge panels are then permanently seamed together forming a weathertight seal along the ridge.

The area at the ends of the ridge adjacent the rakes of the building are covered by filler panels. The filler panels are inverse-V in shape and formed to the pitch of the roof. They have openings corresponding to the standing seam rib along the ridge and these openings are also covered by seam caps. All of the joints between the ridge panels and roof panels, the ridge panels and filler panels, the filler panels and roof panels and the seam caps and standing seam ribs are sealed with tape mastic or sealant.

BRIEF DESCRIPTION OF THE DRAWINGS

FIG. 7 is a broken away, enlarged view of the top of a portion of one of the halves of the ridge panel showing the seam cap notch with upturned edges;

FIG. 8 is a cross-section of the ridge panel of FIG. 7 taken along the line 8—8 thereof;

FIG. 9 is a perspective view of a seam cap used in accordance with the present invention;

FIG. 10 depicts the two halves of a ridge panel with seam caps installed thereon and with the two halves being situated in the relative positions in which they would be installed on a building;

DESCRIPTION OF THE PREFERRED EMBODIMENTS

Figure 1:
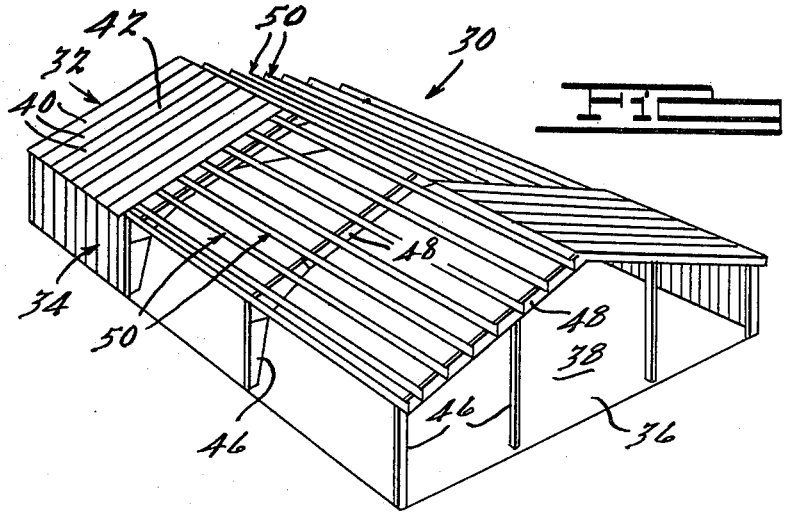
FIG. 1 is a simplified perspective view of a building in the process of construction showing an environment in which a ridge structure and system embodying the invention is used.

FIG. 1 shows a building 30 with a low profile roof structure 32, sidewalls 34, an end 36, and a floor 38. The roof structure comprises a large number of metal panels 40 which are substantially identical in shape, elongated, and laid side by side, In final assembly the panels are interlocked and seamed together so that each side surface 42 of the roof becomes substantially a one piece membrane formed of a series of integrated panels. The sidewalls 34 are illustrated as consisting of panels 44 erected side by side and fastened together, but it is understood that other sidewall constructions can be used on the sides of the building 30 to enclose and finish it. It is preferable that the sidewalls 34 be erected prior to the roof structure since, as seen best in FIG. 2, the overhang of previously installed building panels 40 would intefere with erection of the sidewall panels 34.

The building 30 has any suitable framework, such as arches, formed by the vertical members 46 that support the inclined transverse roof beams 48. The beams 48 support the horizontal longitudinal purlins or rafters 50 of the roof structure. The upper purlin flanges 52 define roof planes for the roof surfaces 42 that are plumb and square and that support the panels 40 and panel mounting clips 54.

Preferably, the building panels 40 have a cross sectional configuration which not only strengthens them, but enables adjacent panels to be movably interlocked or hinged and, later, to be tightly joined together in a common mechanical seam. The mechanical interlocks between adjacent panels in conjunction with the clips 54 hold them substantially in place while the remaining panels are being run and until seaming can be finished thereby minimizing the possibility of their disruption due to gusts of wind, etc.

The present ridge system invention can be used with any roofing system which has interlocking or mating roof panels and which form a raised joint when adjacent panels are permanently fastened together. Preferably, however, the present invention is used with standing seam roof system and more particularly with the standing seam roof system defined by the aforementioned U.S. Pat. Nos. 4,193,247, 4,213,282 and 4,224,775.

In accordance with those patents, each panel 40 comprises a central bottom wall portion which may be flat, as shown, or reinforced in a suitable way such as by a series of transverse embossed ribs (not shown) pressed into it. The panel has opposite sidewalls 58 and 60 extending upwardly and outwardly from the bottom 56 at angles of substantially 60 degrees to the horizontal, i.e., to the plane defined by the bottom 56. The sidewalls 58 and 60 are substantially mirror images of each other, except for top flanges 62 and 64, respectively, and like features are therefore given the same reference numbers. Thus, the sidewalls 58 and 60 include outwardly slanted vertical bottom wall sections 66 having top ends which are joined by horizontal shelf sections 68 to the bottom ends of outwardly slanted, vertical, intermediate wall sections 70. Horizontal rims 72 extend outwardly from the top ends of the wall sections 70 and terminate at the bottom ends of seaming ribs 74 and 76 that form upper panel sections that extend, preferably, at right angles to a plane defined by the bottom wall 56. The ribs 74 and 76 define the maximum widths of the panels. Ribs 74 are slightly higher than the ribs 76 so that flanges 62 will fit over the tops of flanges 64.

Figure 4:
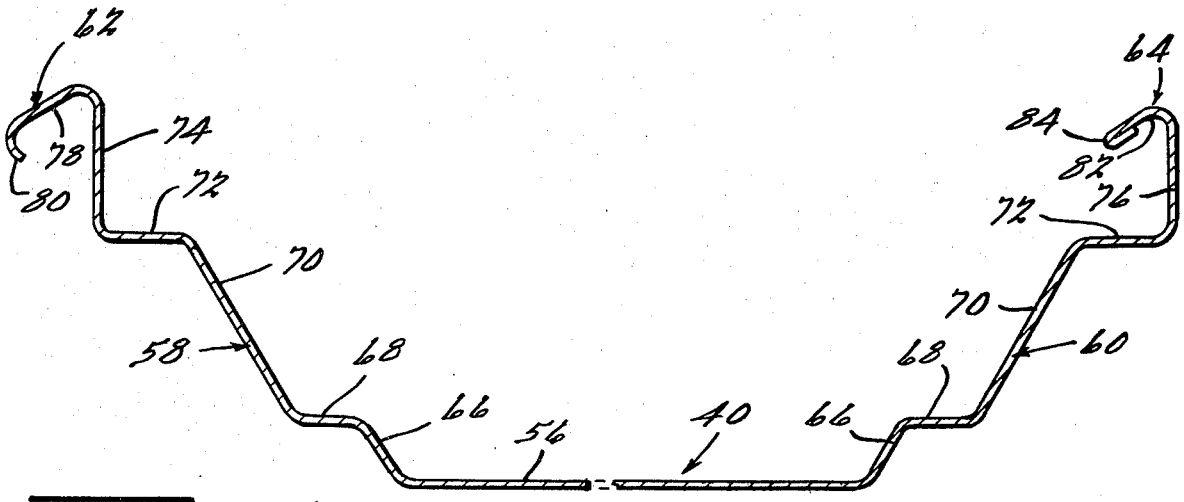
FIG. 4 is an enlarged cross-sectional view of a roof panel, taken along the line 4—4 of FIG. 3.

The top flange 62 extends outwardly from the top of its rib 74 at an angle of substantially 60 degrees to it (about 30 degrees to the horizontal or plane of bottom 56); and the top flange 64 extends inwardly from the top of its rib 76 at an angle of substantially 60 degrees to it. The top flange 62 (the female portion) is a little wider than flange 64 (the male portion) and has an inner section 78 that extends outwardly and 30 degrees to the horizontal) and an outer section or lip 80 that extends inwardly and downwardly at an angle of substantially 60 degrees to the inner section 78 (about 30 degrees to the horizontal and 120 degrees included angle) for a distance substantially as indicated by the dimensional relationship shown in the drawings (e.g. FIG. 4) so that a part of it will be vertically below a flange 64 after installation. The top flange 64 has an inner section 82 that extends inwardly and downwardly toward bottom 56 at an angle of substantially 60 degrees to its rib 76 (about 30 degrees to the horizontal) and an end section 84 that is doubled back toward rib 76 to form a reversely bent bulb-like end edge portion for the flange 64. It will be noted that suitable radii are provided at the various corners and bends and that the panel 40 are of a shape that can be roll formed from sheet metal in accordance with known methods and using roll stand equipment that is commercially available. The particular angles disclosed with respect to flanges 62 and 64 have been found to be preferable in that they facilitate assembly while maintaining interconnection.

Figure 13:
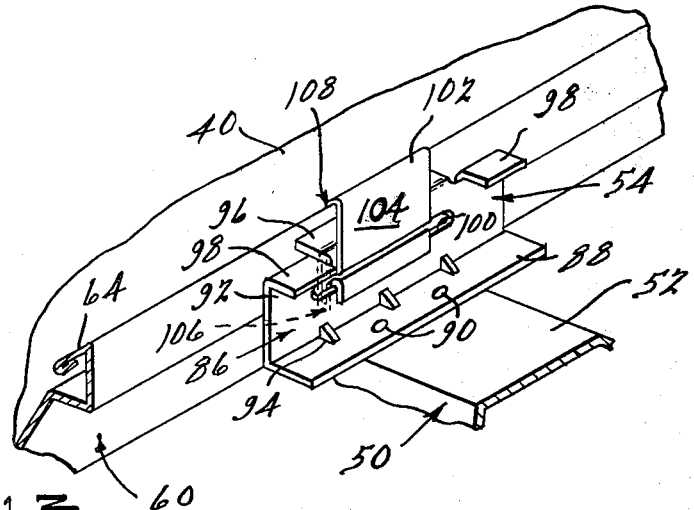
FIG. 13 is an enlarged broken away perspective view similar to FIG. 2 showing the panel mounting clip, panel and purlin.

Referring to the panel mounting clip 54, best illustrated in FIG. 13, the construction of this member enables it to assist in holding the panels 40 in place after they are laid. Preferably, as set forth in U.S. Pat. No. 4,193,247, the clip 54 includes means that cooperate with the interlocked panels to permit the panels to expand and contract relative to the purlins 50 in response to pressure differentials and changes as well as temperature differentials and changes during the life of the roof, thereby minimizing roof stressing induced by differential loading. The panels mounting clip 54 is preferaby formed of sheet metal and has a channel shaped base member 86 with a lower horizontal flange 88 that is adapted to be secured to purlins 50 by screw fasteners 90 or the like. The member 86 has a vertical web 92; several gussets 94 may be pressed in it and in the bottom flange 88 at the corner to provide rigidity to the bottom end of the clip. The top flange of the base member 86 has a central section 96 which is parallel to the bottom flange 88 but which is bent to extend in the opposite direction. On either side of the top flange 96 are a pair of top end flanges 98 which extend in the same direction as the bottom flange 88 and are prallel to it. The flanges 96 and 98 provide shelves which fit beneath the rims 72 of the panels 40 to provide means on which the panels may be supported if their weight is not carried directly by support of the bottoms 56 on the purlins.

Figure 2:
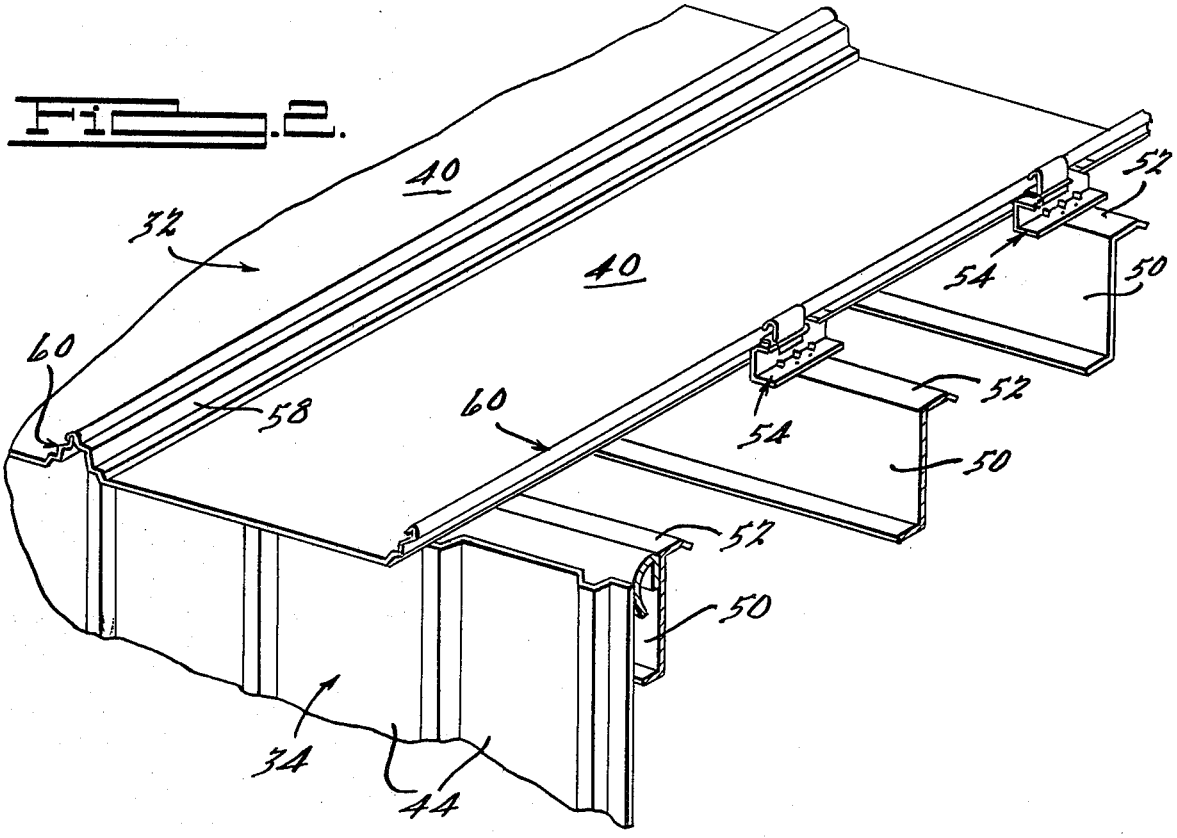
FIG. 2 is a broken away perspective view (on an enlarged scale as compared with FIG. 1) showing how metal building panels are installed on the roof of the building of FIG. 1.

The web 92 has a horizontal slot 100 extending through it which is substantially coextensive with the flange 96. A flap-like tab clip 102 is mounted in the slot 100 and is capable of sliding movement from one end of the slot to the other. Tab clip 102 is preferably formed of thinner metal than is the base member 86 and is somewhat resilient so that its vertical web portion 104 is biased toward the surface of web 92, but can also move transversely away from it. The bottom of the tap clip 102 has a special resilient loop configuration which includes a double reverse bend portion 106 that extends upwardly and downwardly after passing through the slot 100 and is shaped to press against the back of the web 92, as described in more detail in U.S. Pat. No. 4,193,247, the disclosure of which is hereby incorporated herein by reference. The double-reverse bent section 106 forms a resilient loop-like holding mechanism for the tab which clamps it to opposite sides of the web 92, but permits it to slide in the slot 100 between flanges 98. The bent section 106 also provides a spring action that tends to hold the tab clip 102 in vertical position as shown in FIGS. 2 and 13. Since the tab clip 102 is of relatively thin metal it can be bent resiliently to some extent in different directions to accommodate thermal stresses in the panels 40 and roof structure 42.

The mounting clip 54 also preferably has a means, such as a dimple and hole arrangement (not shown), in order to yieldably hold the tab clip 102 in a centered position along the midline of the member 86. Such a mechanism should hold the tab clip in its centered position during assembly of the roof structure, but allow the tab clip to move longitudinally relative to the base member 86 to compensate for movement of the panels caused by thermal forces.

Figure 14:
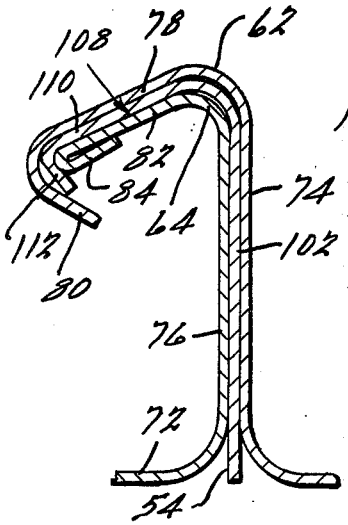
FIG. 14 is a cross-sectional view showing a mounting clip positioned in place between two mating and interlocking panels prior to seaming.
Figure 15:
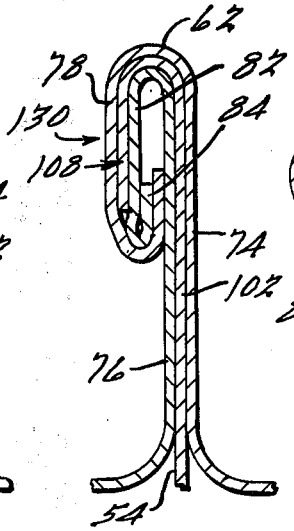
FIG. 15 is a cross-section of the joint of FIG. 14 after seaming.
Figure 16:
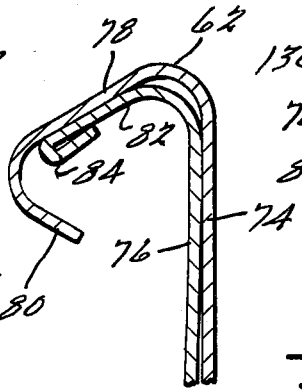
FIG. 16 is a cross-section through a panel to panel joint prior to seaming.

The top end of the tab clip 102 has a hook-like flange 108 which is very similar to panel flange 62. Thus (as shown in more detail in FIG. 14), it has a section 110 that extends outwardly and downwardly at an angle of substantially 60 degrees to the vertical position 102. The height of portion 102 above the plane of the top surfaces of flanges 96 and 98 is a little more than that of a flange 64 above the rim 72. The transverse length of the section 110 is also a little more than that of flange 64. The flange dimensional relationships enable the flange 108 to snugly fit over and its end lip 112 to hook onto flange 64 and at the same time for the panel flange 62 to fit over, hinge around, and hook onto the combined flanges 64 and 108 (FIGS. 14–15) as well as single flanges 64 (FIGS. 2 and 13), In practical application, the framework of the building 30 is first erected followed by the side walls 34. After this is done, the panels 40 may be laid on the purlins 50 starting from the left and moving toward the right end of the roof sections 42 (See FIG. 1). Ignoring special procedures known to those in the art for handling the structure at the ends of the roof section (using rakes and other end components), a panel 40 is laid across the purlins 50 and may be allowed to rest there under the force of gravity and resistance of friction. Then the panel mounting clips 54 are positioned on the purlins 50 and lined up with the right side wall 60 (male member) of the panel so that the flanges 96 fit under the rim 72. The top flange 110 and hook lip 112 extend over and around the flange 64 on the side wall 60. The actual connection can be made by first hooking the flange 110 on the flange 64 and hinging the clip 54 around to the vertical position indicated. When this is done, the clips 54 are firmly anchored to the purlin, as by screws, etc. This, of course, also anchors the side wall 60 of the panel 40 to the purlin so that it cannot move upwardly away from it.

The next step in the assembly procedure is to attach another panel 40 in side-by-side relationship to the panel that has just been anchored in place. This is done by interconnecting the side wall 58 of the second panel to the side wall 60 of the first and anchored panel. More particularly, it is done by placing the flange 62 (female member) over and around the flange 64 (male member) so that the latter is nested inside of the force. This interconnection is accomplished by tilting the panel 40 that is being attached at an angle to the horizontal so that the lip edge 80 fits under the section 82. When this relationship has been accomplished, the panel 40 is hinged in a clockwise manner until its bottom 56 comes to rest against the purlins 50. The particular angles used on the panel flanges as disclosed in U.S. Pat. Nos. 4,193,247, 4,213,282 and 4,224,775, make this interconnection relatively easy to achieve. At this point, the roof structure will resemble that shown in FIG. 2.

Figure 17:
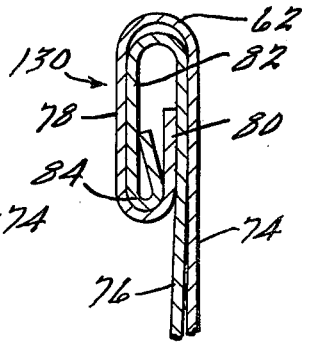
FIG. 17 is a cross-section through the joint of FIG. 16 after seaming.

After the second panel 40 has been hooked to and hinged around the anchored panel as just described, panel mounting clips 54 and hooked to its side wall 60 and secured in place on the purlins 50 as already described for the first panel. This process of hooking a panel being added to the roof section to one already anchored on the roof section, hinging it down until it rests on the purlins, fastening the panel mounting clips to the side wall of the panel and then to the purlin, is repeated until all the panels 40 that are desired to be installed are in place. It will be noted that in this condition the panel mounting clips 54 together with the loose hook type interlock between flange pairs 58 and 60 will integrate the panels so that they in fact form a unitary though flexible roof structure 42. This flexibility is then materially reduced by running a suitable seaming tool along the upright upper vertical rib sections 74 and 76 to bend the flanges 62 and 64 against the inside face of upper section 76 on side wall 60 to achieve the compressed, interlocked final standing seam 130 shown in FIGS. 15 and 17. When this is done the lip 112 of the panel mounting clip tab 102 may in some structures be flattened out, as seen by comparting FIGS. 14 and 15, but this has no undesirable effect since it is apparent that the clip 54 still serves to resist movement of the joint in an upward direction away from the purlins 50. It does have a beneficial effect in that it makes it somewhat easier for the tab 102 to move longitudinally relative to the upper sections 74 and 76 of adjacent panels. Such relative movement is, as previously mentioned, accommodated by the slot 100, the spacing between flanges 98, and the dimple and hole mechanism of the panel clip construction and permits differential force systems introduced by temperature changes, pressure changes, etc. between interconnected panels to dissipate themselves in relative movement of the panels rather than in deformation or buckling of the panels. The resiliency of the tabs 102 also permits the interconnected panels 40 to have flexibility as a roof membrane relative to the purlins 50 and structure 46 and 48.

Figure 5:
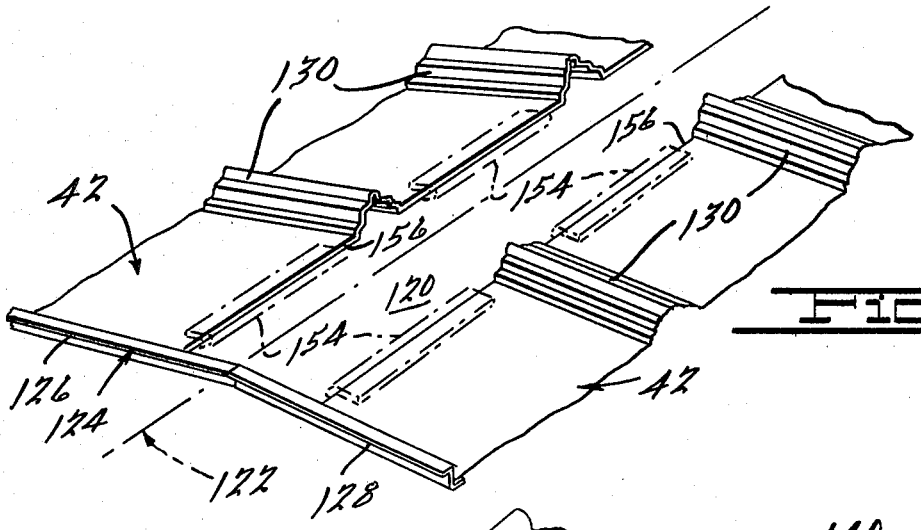
FIG. 5 is a simplified perspective view of a roof of a building showing the gap at the ridge ready for installation of the present invention.

After the two sides of the roof structure 42 are completed, a gap 120 exists between the two sides along the ridge or peak 122 of the building (see FIG. 5). The gap extends along the full length of the building between the two end rakes 124 (only one is shown). The end rakes 124 have formed pieces of metal 126 and 128 which are fixed along the sloping edges of each side of the roof structure 42 and finish it both structurally and aesthetically. The finished seams 130 extend up the sloping sides of the roof structures and terminate in the open-ended configurations along the edge 156, as shown in FIG. 5.

Figure 3:
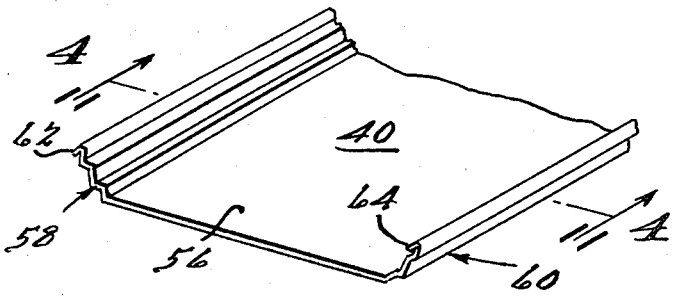
FIG. 3 is a broken away, perspective view looking down on the top of a panel used to form the roof system of the building of FIG. 1.
Figure 6:
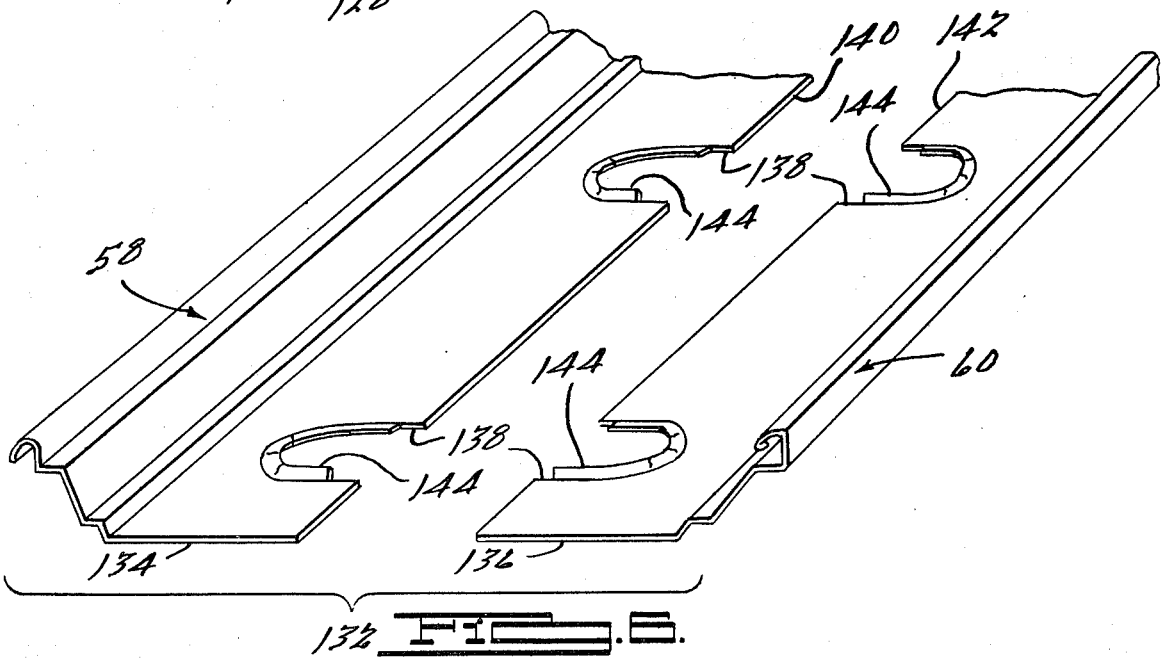
FIG. 6 illustrates the two halves of the ridge panel of the present invention with the notches formed therein.

The ridge panels 132 of the present invention are comprised of two sections 134 and 136, as shown in FIG. 6. These sections are made of sheet metal and have sufficient width to overlap the edges of the roof structure 42 and meet in the middle of the gap along the ridge line 122. Preferably each half of the ridge panels has a mating edge configuration similar to the sidewall and flange configurations 58, 62 and 60, 64 on the panels 40 described above. Of course, it is understood that the mating edge configurations can be of any type which will tightly join together or interlock and be seamed together with a seaming tool, but for simplicity in manufacture, installation and on-the-job labor convenience, it is preferable if the edge configurations are the same as those found on the main roof panels 40. Moreover, if the same mating edge structures are used, it is possible to make the ridge panel from one roof panel which has been cut or slit in half down the middle. For ease of description, the ridge panel shown in FIG. 6 will be treated as if it were a panel 40 which has been divided into two sections 134 and 136. Thus, the mating female edge structure 58 on section 134 is the same as that described above relative to FIGS. 2–4 while the mating male edge structure 60 on section 136 is the same as that described above relative to the same FIGS. 2–4.

After the two sections 134 and 136 are formed, a plurality of U-shaped openings 138 are notched or cut-out along the flat slit edges 140 and 142 of the sections. The openings 138 are separated the same distance apart as the standing seam ribs 130 on the completed roof structures 42. Preferably, the notches are located along the slit edges at intervals matching the nominal coverage of the standing seam roof panel's width. Also, there are the same number of openings 138 along each of the ridge panel sections 134 and 136 as there are standing seam ribs 130 on the roof.

The inner curved edges of the notches 138 are cut into sections and bent upwardly to form a reinforcing lip 144 around the perimeter of the notch. This is shown in FIGS. 7 and 8.

Metal caps 150, as shown in FIG. 9, are provided which are secured in place over each of the openings 138. The caps (also called "seam caps") are preferably made of aluminized coated steel (22 gage) and are formed by conventional deep drawing techniques. The seam caps have an outer flange 151 around three sides of the perimeter and a central configuration 153 which is formed to be the same shape as the seamed ribs 130 as closely as possible). Thus, a cross-section taken through the middle of the cap 150 through the central configuration 153 would look the same as a cross section through a standing seam rib 130, as shown in FIGS. 2 and 5, except slightly bigger in dimensions.

Each notch or opening 138 on the male and female halves 134 and 136 has a cap 150 attached over it. The upturned lips 144 fit inside the caps 150 and properly position the caps on the ridge panel section. The caps are weather sealed with butyl rubber tape sealants or other comparable and conventional sealants and then fastened securely by rivets 152 to hold the caps permanently and securely in position. A pair of mating ridge panel sections with the seam caps thereon are shown in FIG. 10. Preferably, four rivets 152 are used to secure each of the caps to the panels.

Preferably, the male and female halves with seam caps attached are prepared and packaged at the factory and shipped to the building site in mating pairs. At the site, it is possible to adapt the ridge panel sections to any variations in panel positioning, standing seam rib arrangement, or the like. It is also possible, of course, for the ridge panel halves to be formed on site. In this instance, a main roof panel is slit in half, the notches are cut out, and the seam caps are riveted in position by the roofing crew. Also, a crude type of reinforcing lip can be formed in the field. In this manner, it is also possible to modify the ridge panels to compensate for any variations on dimensional or structural configurations.

Before the ridge panel sections are installed in place on the roof structure 42, it may be necessary to install ridge stiffeners 154 along the upper edges 156 of the panels 40 (FIG. 5). The ridge stiffeners 154 are typically elongated U-shaped channel members made of sheet metal or the like and are fitted over the edges 156 of the panels in the manner shown in phantom lines in FIG. 5.

Figure 11:
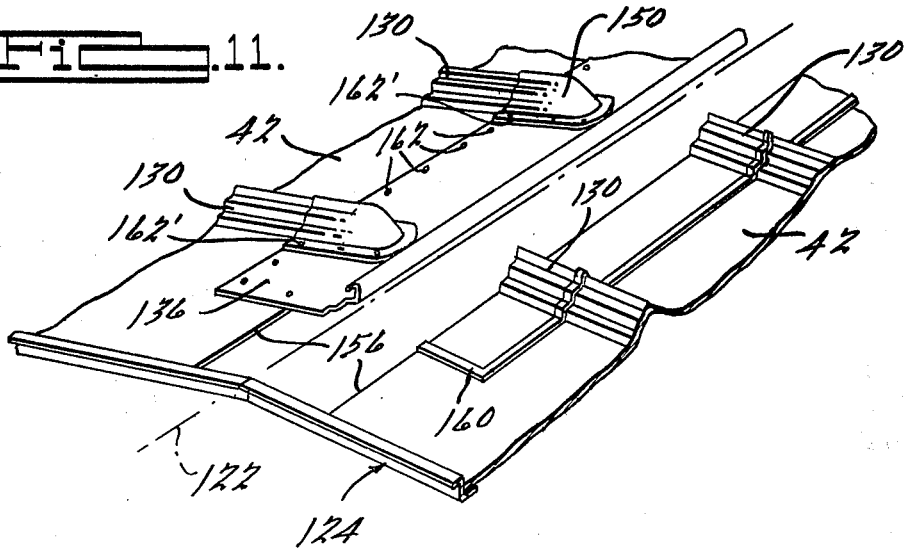
FIG. 11 is a simplified perspective view of a roof ridge gap on a building with one of the ridge panel halves (the male half) fastened in place.

When the ridge panel sections are installed, the male half 136 is first positioned and fastened in place. A tape sealant or other comparable sealant means is positioned on the roof structures 42 corresponding to the perimeter of the roof panel sections. As shown in FIG. 11, the tape sealant 160 is fixed in position in preparation for the female half 134 and a corresponding sealant (not shown) is utilized under the male half 136. In order to properly position the male ridge panel section 136 on the precise ridge or peak 122 of the building, a string line or other suitable means is utilized to mark the ridge line. When the male half 136 is positioned in place, it is aligned with the string line and then permanently fastened to the roof structure by rivets 162 which preferably are stainless steel metal fasteners. For best results, one fastener 162' is installed on each side of the ribs 130 through the flanges on the seam caps (and through the roof panel), while four additional fasteners 162 are installed between the ribs (equally spaced apart).

The ridge installation is continued until male ridge panel members are installed along the full length of one edge 156 of roof structures 42. At each overlap or joint between male ridge panel members, additional tape sealant and two fasteners are utilized to secure the joint.

After the completion of the male side of the ridge structure, the string line or peak marking mechanism is removed and the female side is started. Each of the female ridge panel sections 134 is interlocked with a male ridge panel section in the same manner as adjacent roof panels 40 are installed and interlocked together to form the roof structures 42, (as described above with reference to FIGS. 1–4). Once the mating edge structures 58 and 60 are overlapped, rotatably assembled and interlocked together, the female panel sections 134 are pressed firmly in place over the tape sealant 160 and permanently secured to the roof structure 42 by rivets 162 or other comparable fasteners. The female panel sections 134 are secured to the roof structure and positioned and secured in overlapping arrangement (where required) in the same manner as the male ridge panel sections.

The ridge panel sections 134 are laid the length of the roof ridge until the full length of the remaining side of the roof ridge is covered. Additional tape sealant is installed under the extreme ends 168 of each of the series of male and female sections (see FIG. 12) and conventional rivets or fasteners 163 are utilized to permanently secure the ends 168 to the roof structures 42.

When both slopes are completed on the ridge of the building, the mating edge structures 58 and 60 of the ridge panel halves are permanently closed and seamed together by a suitable lock forming machine, seaming tool or the like. The edge structures are roll formed into a standing seam rib 166 in the same manner that the mating edges of the main roof panels 40 are roll-seamed tightly and permanently together. The completed ridge structure with mating male and female sections is shown in FIG. 12; the final construction of the mating edge structures 58 and 60 forming rib 166 is shown in more detail in FIG. 17.

Figure 12:
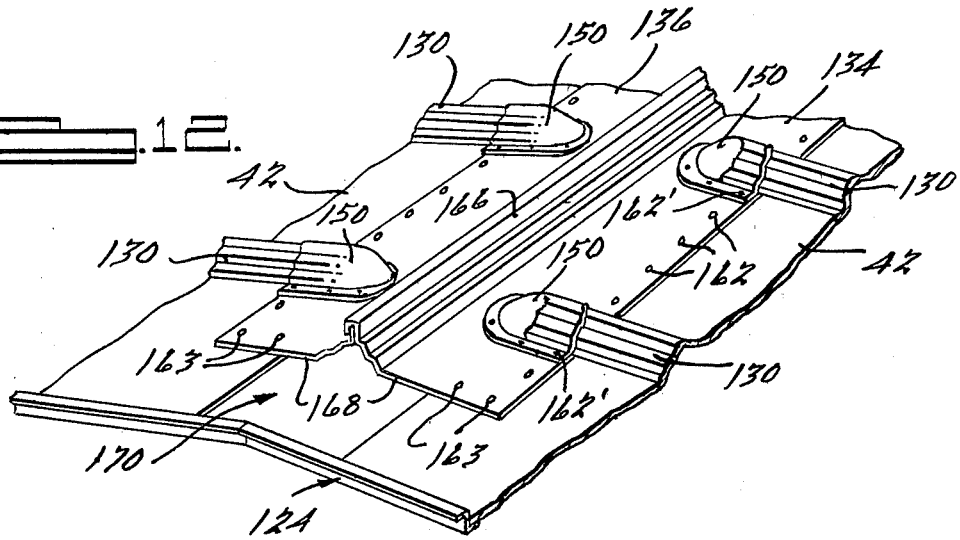
FIG. 12 is a simplified perspective view of a roof ridge gap on a building with both halves of the ridge panel installed in place.
Figure 19:
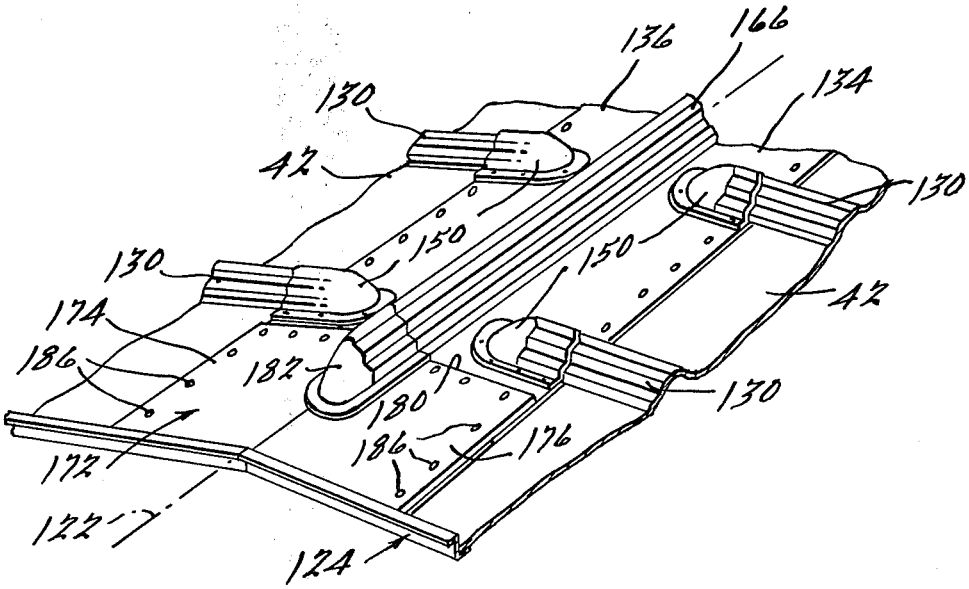
FIG. 19 is a simplified perspective view of a roof ridge structure in accordance with the present invention and showing a representative rake filler panel.

When the main part of the ridge structure is completed, smaller gaps 170 are left at each end of the ridge adjacent the end rakes 124 (FIG. 12). The gaps 170 (only one is shown) are covered with ridge end caps or filler panels 172 (FIG. 19). The filler panels are pieces of sheet metal preferably of the same quality and thickness as the roof panels 40 and are bent into two parts 174 and 176 along the peak line 122 to form an inverse V-shape structure with each part angled to the pitch or slope of the roof.

In the same manner and for the same purpose that U-shaped notches are cut-out of the ridge panel sections and that seam caps are installed over the notches, openings 138 are cut along one edge 180 of each of the filler panels (centered at the peak line) in order to accommodate the ridge standing seam rib 166 along the ridge. (For ease of description, the structure shown in FIGS. 7 and 8 is used to describe the notches.) Upturned reinforcing lips 144 are similarly formed around the perimeter of the openings 138 and seam caps 182 are positioned and installed over the openings. The seam caps 182 are substantially the same as the seam caps 150 and are sealed, positioned on and permanently affixed to the panels 172 in the same manner that the caps 150 are secured to the panels 134 and 136.

Figure 18:
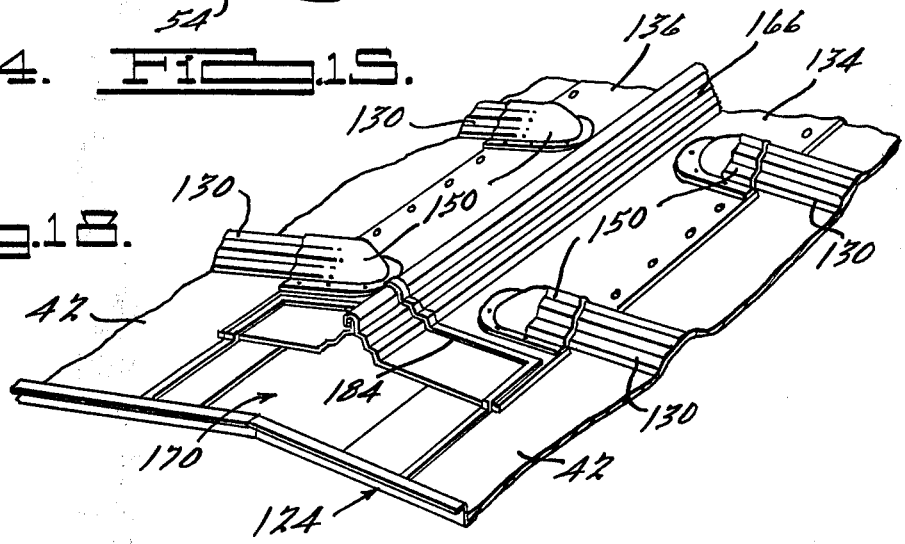
FIG. 18 is a simplified perspective view of a roof ridge gap with the inventive ridge panel installed similar to FIG. 12, and also showing the mastic tape used to weather seal the panels together.

The filler panels 172 are installed in place on the roof structures 42 and sealed with strips of tape mastic 184 (as shown in FIG. 18). A plurality of rivets or metal roof fasteners 186, which are similar to fasteners 162, are used to permanently attach the filler panels to the roof panels (FIG. 19). Once the two filler panels are installed over the end gaps 170, the ridge structure and system in accordance with the present invention is complete.

Figure 20:
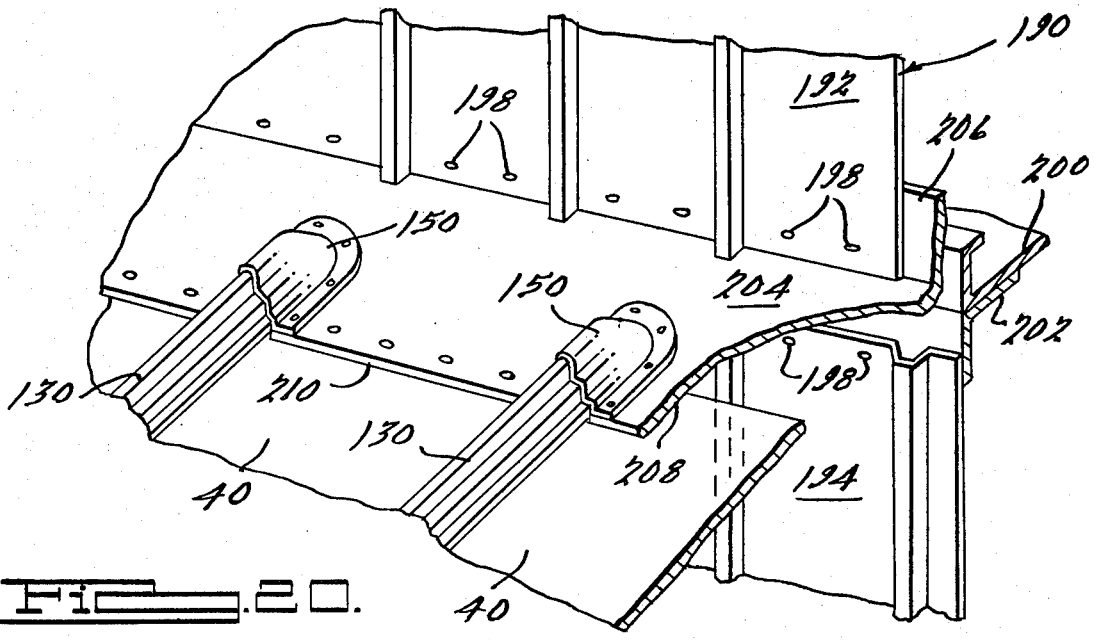
FIG. 20 depicts the use of the invention in another form of building roof.
Figure 21:
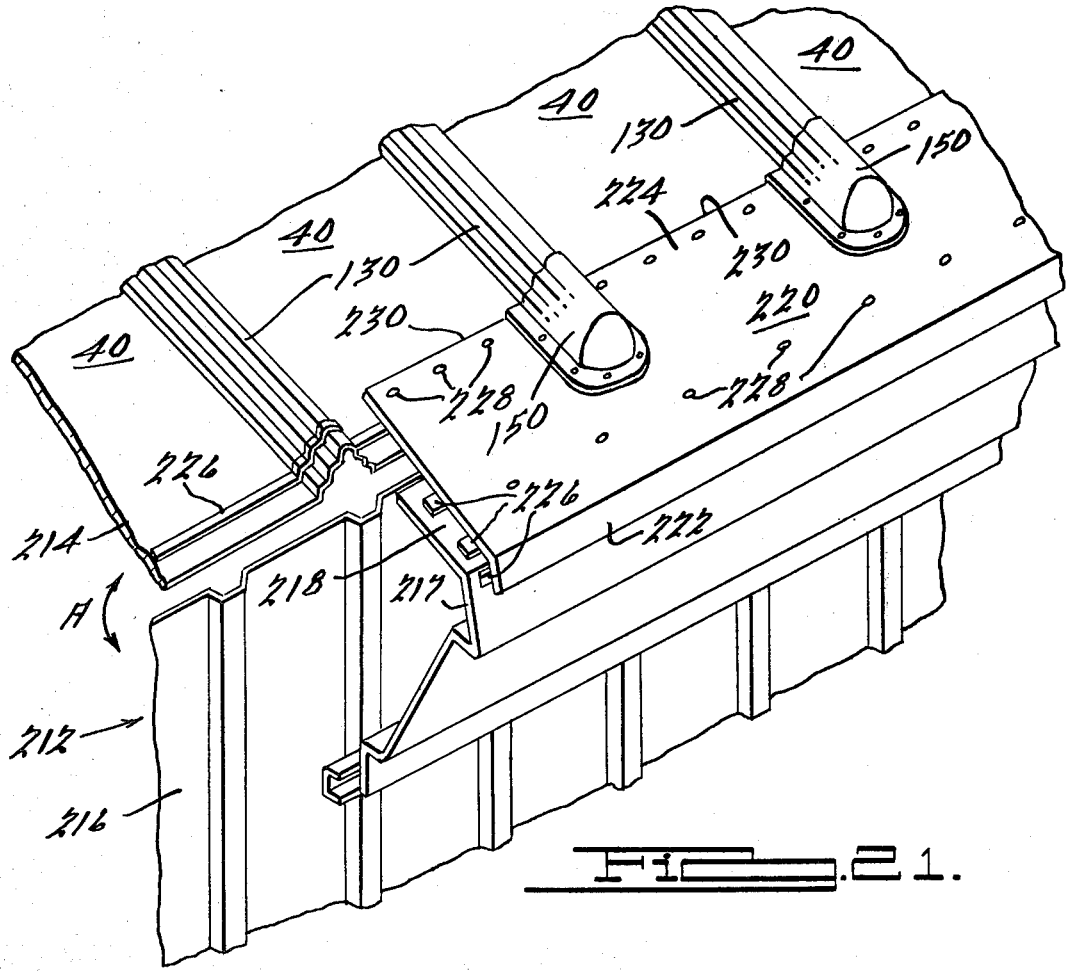
FIG. 21 depicts the use of the invention in a further form of building roof.

FIGS. 20 and 21 illustrate modifications of the inventive roof system when used with other types of building roofs, that is roofs (or portions thereof) which do not have a peak or ridge formed from two opposing sloped surfaces. In FIG. 20, the roof shown has a single slope and is attached to a side or wall 190 of a building. The sidewall 190 has an upper section 192 and a lower section 194, both comprised of metal panels similar to the wall panels 44 described above relative to FIGS. 1–2. Due to the design of the building, a sloping or "lean-to" type roof structure 196 covers a portion of the building; the roof 196 is attached to the building along the sidewall 190 and separates the wall into upper and lower sections 192 and 194. The roof structure 196 is made from individual metal panels 40 as described in detail above and is supported on an appropriate supporting framework (not shown). Also, the panels 40 are seamed together in the manner above-described forming standing seam ribs 130.

The upper and lower sidewall panels 192 and 194 are attached as by stainless steel roof structural fasteners 198 to structural supports 200 and 202 which are part of the structural framework of the building. A formed piece of sheet metal or roofing panel 204 is used to make the connection between the sidewall 190 and the roof structure 196. An upwardly bent flange 206 on the metal panel 204 is securely fastened between the upper sidewall section 192 and the structural support 200 of the building. The remaining section 208 of panel 204 is adapted to be positioned on the roofing panels 40 and have the same slope as the roof structure 196.

The joint between the metal panel 204 and the roofing panels 196 is the same as that described above relative to the connection between ridge sections 134 or 136 and the roof structures 42. In this regard, notches or cut-outs are formed along the edge 210 of the metal panel 204 corresponding to the positions of the standing seam ribs 130. Seam caps 150 are fastened to the panel 204 covering each of the notches. When the panel 204 is installed in the position shown in FIG. 20, the seam caps are situated over and seal the ends of the ribs 130. Also, the seam caps 150 are sealed to the panel 204 and the panel 204 is sealed to the roof structure 196 with tape sealants, as described above.

FIG. 21 depicts the use of the invention on a building 212 with a shed-type roof structure 214 thereon. The roof structure 214 is made from a series of interconnected metal panels 40 as described above. The roof 214 is attached to a sidewall 216 at an angle "A" which is less than 90 degrees. A fascia support 217 is installed in a conventional fashion on the upper edge of the sidewall 216 and has an upper surface 218 which is substantially in the same plane as the main part of the roof structure 214. A formed piece of sheet metal or roofing panel 220 is used to finish, cover and seal the joint between the roof structure 214 and the sidewall structure 216. The panel 220 has a downwardly turned flange 222 which extend over the edge of the fascia 217 and a larger main section 224 which covers the upper surface of 218 of the fascia and overlies a portion of the roofing structure 214. The metal panel 220 is securely held in place and sealed by tape sealants 226 and conventional roof fasteners 228.

In the same manner that the ends of the ribs 130 are covered and weather-sealed by seam caps, etc. as described above, the metal panel 220 is similarly adapted to mate with and seal the end of the roof panels 40 and seamed ribs 130 shown in FIG. 21. In this regard, notches or cut-outs are formed along the edge 230 of the metal panel 220 corresponding to the positions of the standing seam ribs 130. Seam caps 150 are then fastened to the panel 220 covering and weathersealing each of the notches. When the panel 220 is installed on the building, the seam caps are positioned over in a sealing relationship with the ends of the ribs 130.

The present inventive ridge system has a number of features, benefits and advantages. It compensates for thermally induced movement in the roof panels; it can accommodate different major rib alignment on each slope of the roof; it allows for pitch changes in the plane of the roof panels; it can easily accept ridge mounted roof accessories; it locates the weatherseal at the surface of the roof panels; it resists damage by foot traffic during installation, etc.; and it allows for exterior surface finishes along the ridge structure which are compatible with the finishes of the roof panels. The present invention accomplishes these features with a minimum number of components, with components that are relatively simple to use and install, with an installation that is less expensive to install (i.e., needless labor time), with a system that is adaptable to various conditions, and with a system that assures high quality in installation and performance. Also, a completely weathertight joint is formed down the entire length of the building roof ridge or roof connection without any mechanical fasteners being used.

This detailed description of the preferred embodiments, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While preferred embodiments of the invention have been described herein, it will be appreciated that various modifications and changes may be made without departing from the spirit and scope of the appended claims.

We claim:

1. A roof ridge system for enclosing the ridge of a building roof, said building roof having at least two surfaces covered with raised rib seam roofing panels whereby said raised rib seams may be of non-uniform height and spacing, said ridge system comprising:

a first ridge panel section connected to one of the roof surfaces and having a plurality of notches corresponding to the raised rib seams along said surface, a second ridge panel section connected to another of the roof surfaces and having a plurality of notches corresponding to the raised rib seams along said surface, said first and second ridge panel sections being interlocked together to form a raised rib seam substantially along the ridge line of said roof, and a plurality of cap means positioned on said first and second ridge panel sections, each of said cap means covering one of said notches and an end of said raised rib seams of said roofing panels.

2. The system as set forth in claim 1 further comprising a filler panel positioned adjacent an end of the roof ridge, said filler panel having a notch therein corresponding to the raised rib seam along the ridge line of the roof and a filler panel cap means positioned on said filler panel and covering said filler panel notch and the end of the raised rib seam along the ridge line of said roof.

3. The system as set forth in claim 1 wherein said notches in said first and second ridge panel sections have reinforcing means thereon.

4. The system as set forth in claim 1 wherein said notch in said filler panel has reinforcing means thereon.

5. A structure for covering the open ridge area of a metal building having at least two opposing and sloping roof surfaces, said building having a plurality of interlocked metal roofing panels with raised rib seams of umiform or non-uniform height and spacing on said roof surfaces, the improvement comprising;

a first ridge panel secured to the roofing panels on one of said roof surfaces and having a plurality of notches corresponding to said raised rib seams, a second ridge panel secured to the roofing panels on a second of said roof surfaces and having a plurality of notches corresponding to said raised rib seams, said first and second ridge panels being interlocked together to form a raised rib seam substantially along the ridge line of said roof, and a plurality of seam caps positioned on said first and second ridge panels, each of said seam caps covering one of said notches and an end of said raised rib seams on said roof surfaces.

6. The structure as set forth in claim 5 further comprising filler panel means for covering the ends of the open ridge area whereby a filler panel is positioned adjacent an end of said ridge area, said filler panel having a notch therein corresponding to said raised rib seam along the ridge line of the roof and a filler panel cap positioned on said filler panel and covering said filler panel notch and the end of said raised rib seam along the ridge line of the roof.

7. A structure for connecting a roof to a sidewall of a building, said roof being covered with interlocked raised rib seam roofing panels whereby said rib seams may be of non-uniform height and spacing, said structure comprising a panel and a plurality of cap means, said panel fastened at one edge to said sidewall and at an opposed edge to said roofing panels, said opposed edge having a plurality of notches corresponding to the raised rib seams along said roof, each of said cap means positioned on said panel and covering one of said notches and an end of said raised rib seams.

8. The structure as set forth in claim 7 wherein said building is a shed-type structure and said roof is connected to the upper edge of said sidewall.

9. The structure as set forth in claim 7 wherein said roof is connected to a mid-point of said sidewall.

10. A structure for connecting a sloped roof surface to a vertical building surface where said sloped roof surface is covered with raised rib seam roofing panels and whereby the raised rib seams may be of non-uniform height and spacing, said structure comprising:

a panel section connected at one edge to said vertical building surface and at an opposing edge to said sloped roof surface, said opposing edge having a plurality of notches corresponding to said raised rib seams along said sloped roof surface, and a plurality of cap means positioned on said panel section, each of said cap means covering one of said notches and an end of said raised rib seams of said sloped roof surface.

11. A roof ridge system for enclosing the edge of a building roof surface where said roof surface is covered with raised rib seam roofing panels which may have said raised rib seams of non-uniform height and spacing, said ridge system comprising:

a ridge panel section connected to an edge of said roof surface and having a plurality of notches corresponding to said raised rib seams along said roof surface, and a plurality of cap means positioned on said roofing panels, each said cap means covering one of said notches and an end of said raised rib seams.

* * * * *

UNITED STATES PATENT AND TRADEMARK OFFICE

CERTIFICATE OF CORRECTION

PATENT NO. : 4,420,913

DATED : December 20, 1983

INVENTOR(S) : Gene M. Long et al

It is certified that error appears in the above-identified patent and that said Letters Patent is hereby corrected as shown below:

Column 1, line 64, "lock" should read -- roof --.

Column 4, line 67, "prallel" should read -- parallel --.

Column 6, line 14, "force" should read -- former --.

Column 6, line 27, "and" should read -- are --.

Column 6, line 47, "comparting" should read -- comparing --.

Column 7, line 52, "gage" should read -- gauge --.

Column 11, line 65, "umiform" should read -- uniform --.

Signed and Sealed this

*Fourteenth* Day of *August 1984*

[SEAL]

*Attest:*

GERALD J. MOSSINGHOFF

*Attesting Officer*

*Commissioner of Patents and Trademarks*